United States Patent [19]

Caverly

[11] 4,044,921

[45] Aug. 30, 1977

[54] SAND BAG FILLING APPARATUS

[76] Inventor: Warren R. Caverly, 900 S. Beard, Shawnee, Okla. 74801

[21] Appl. No.: 675,800

[22] Filed: Apr. 12, 1976

[51] Int. Cl.[2] ..... B67D 5/12

[52] U.S. Cl. ..... 222/74; 222/227; 222/238; 222/415; 198/533; 141/391

[58] Field of Search ..... 222/533, 226, 227, 238, 222/63, 74, 415; 141/391; 198/54, 57, 58, 533, 547

[56] References Cited

U.S. PATENT DOCUMENTS

| | | | |
|---|---|---|---|
| 2,248,700 | 7/1941 | Finnell | 222/238 |
| 2,584,750 | 2/1952 | Spanski | 222/415 X |
| 2,792,153 | 5/1957 | Douglass, Jr. | 222/226 |
| 3,968,626 | 7/1976 | Hobbs | 222/415 X |

*Primary Examiner*—Robert B. Reeves
*Assistant Examiner*—Hadd Lane
*Attorney, Agent, or Firm*—Dunlap, Codding & McCarthy

[57] ABSTRACT

An improved sand bag filling apparatus comprising a hopper having rotatable longitudinal members with radially extending arm members that fluff the sand in the hopper as the longitudinal members are rotated. A powered conveyor belt receives sand from the hopper and moves the sand to a conveyor discharge end whereat is disposed a bag chute. The bag chute has a pivotable nozzle that cooperates with a switch to actuate the conveyor belt when the dispensing nozzle is pivoted in a sand delivery direction.

10 Claims, 5 Drawing Figures

SAND BAG FILLING APPARATUS

BACKGROUND OF THE INVENTION

1. Field of the Invention

The invention relates to an apparatus for receiving bulk material and for dispensing the material to fill containers with the material, and more particularly but not by way of limitation, to an improved apparatus for filling bags with sand.

2. Description of the Prior Art

In the formation of temporary or permanent barricades, bags filled with sand or the like have found extensive use, such as in the damming of water during flood stages. However, the uses of such bags are very extensive, and are not restricted to just emergencies. For example, in oil field construction, sand bags are used to form the banks of slush pits and the like.

Whether the use of sand bags fills an emergency need, or whether the use is a routine construction job, there are at least two considerations in most such uses of sand bags. First, once an acceptable source of sand is found, the bagging equipment should be readily movable to a site in near proximity to the source. Secondly, the bagging apparatus should be able to bag a large number of sand bags at a high rate for the simple reason that it usually is necessary to produce a very large number of sand bags in a relatively short time of operation.

An example of a prior art bagging apparatus is taught by U.S. Pat. No. 3,552,346, issued to Garden. The Garden patent teaches a bagging attachment for the rear end of a dump truck. A hopper receives sand from the truck and delivers the sand to plural bagging chutes while the hopper is constantly vibrated. An auger is used for distributing the sand transversely in the hopper.

While generally successful, the operation of the known prior art devices varies significantly with the quality of the sand available. For example, the sand may contain foreign objects, such as rocks, roots, or other unusable materials. Further, although the term "sand" finds frequent use, this term is used to denote many forms of generally loose dirt or soil. Therefore, the sand may contain varying amounts of clay or other tacky substances that tend to hold the bulk sand together in large clumps or masses.

Finally, the amount of moisture present in the sand will greatly affect the operation of the sand bagging apparatus, as moisture will usually tend to cause clogging difficulties with the known prior art devices. It is not unusual at any given location to dig deeper than just the relatively dry surface sands, and in doing so, the moisture may increase considerably. In any event, the weather conditions often have a notable effect on the moisture content even when a shallow dig is used.

SUMMARY OF THE INVENTION

The present invention presents a sand bag filling apparatus comprising a hopper assembly supported by a frame assembly. Sand received in the hopper assembly is conditioned by rotatable longitudinal members having radially extending arm members. A powered conveyor belt is disposed to receive sand from the hopper assembly and to deliver the sand to a bag chute. An actuating assembly is provided to actuate the powered conveyor belt to deliver sand to the bag chute to fill a sand bag.

In the preferred form, a screen is pivoted over the hopper assembly. Further, a pivotable dispensing nozzle is connected to the bag chute, the selective pivoting of the dispensing nozzle serving to start and stop the travel of the conveyor belt.

Accordingly, an object of the present invention is to provide a sand bag filling apparatus having improved operation with a wide variation of sand material.

Another object of the present invention is to provide a sand bag filling apparatus that provides rapid operation while maintaining ease of operation, offers economy of construction and requires minimum maintenance.

Other objects and advantages will become apparent to the persons skilled in the art in view of the following detailed description and in light of the accompanying drawings and appended claims.

DESCRIPTION OF THE PREFERRED EMBODIMENT

Figure 1:
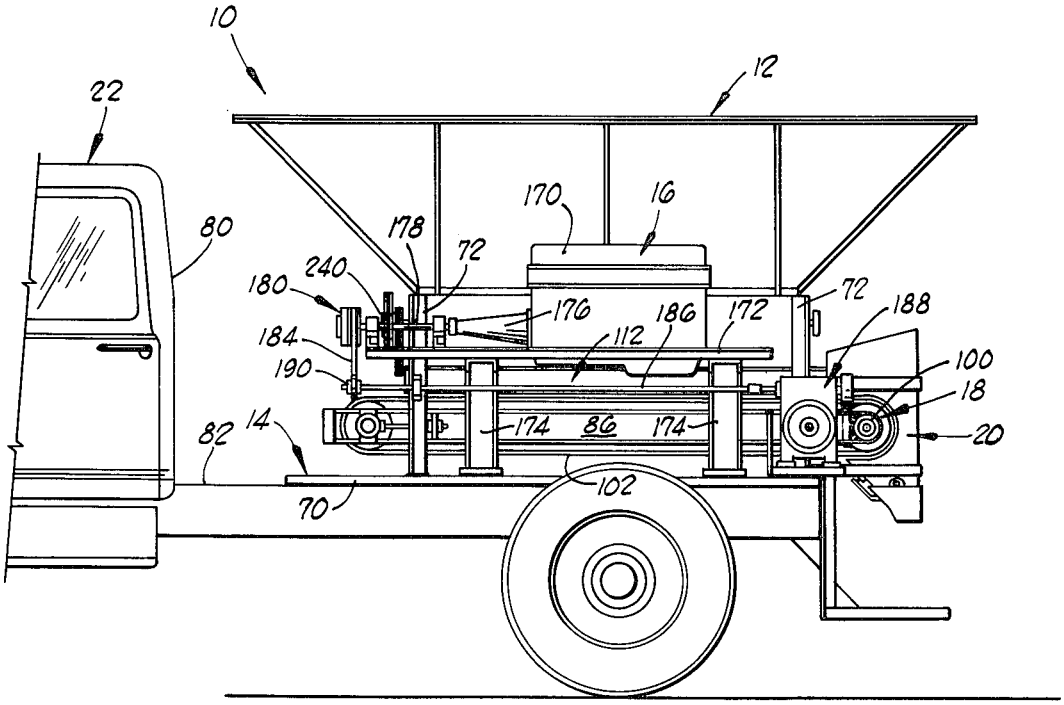
FIG. 1 is a side elevational view of a sand bag filling apparatus constructed in accordance with the present invention.

Referring to the drawings and particularly to FIG. 1, the sand bag filling apparatus of the present invention is illustrated and generally designated by the numeral 10. The sand bag filling apparatus 10 generally comprises a hopper assembly 12, a frame assembly 14, a power plant 16, a conveyor assembly 18 and a bag chute 20. The frame assembly 14, along with the other named components, are supported on a powered platform assembly 22. These components will be described more fully below.

Figure 2:
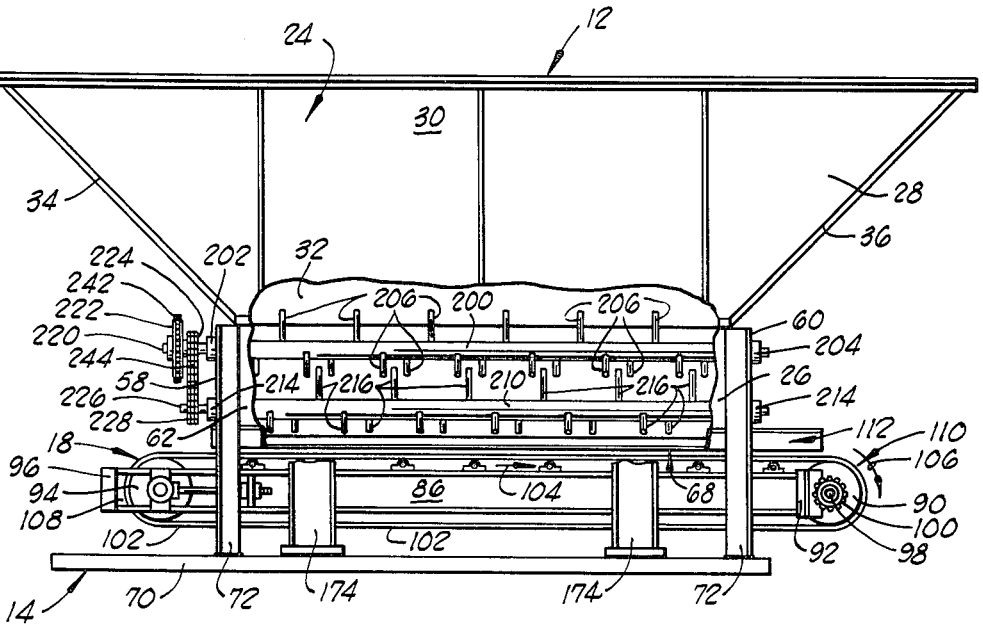
FIG. 2 is an enlarged view of the sand bag filling apparatus of FIG. 1 in partial detail and cut-away view.
Figure 3:
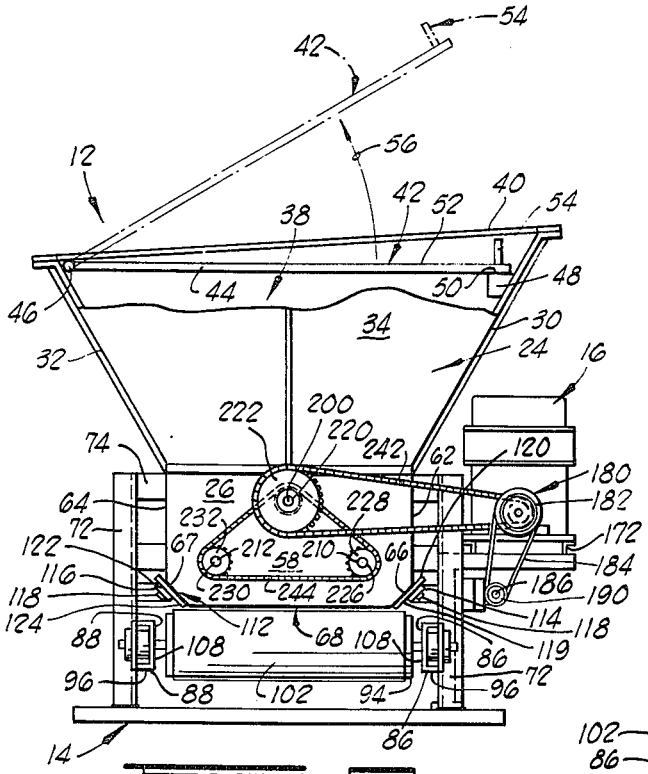
FIG. 3 is an end elevational view of the sand bag filling apparatus of FIG. 1.

Referring to FIG. 2, shown therein is a semi-detailed and partially cut-away view of the hopper assembly 12 and the conveyor assembly 18. The hopper assembly 12 comprises a hopper 24 that has a lower section 26 and an upper section 28. The upper section 28, as discernible by also referring to FIGS. 3 and 4, comprises a first side wall 30 and a second side wall 32, and a first end wall 34 and a second end wall 36. The side wall sections 30 and 32 and the end wall sections 34 and 36 extend angularly upward from the lower section 26 and form a hopper reservoir having a sand receiving opening 38 at the top of the hopper assembly 12. The dimensions of the side walls 30 and 32 and the end walls 34 and 36 are determined so that the top edge 40 of the hopper 24 has a slope or predetermined grade relative to the horizontal. A screen 42 is provided having a screen frame 44 that is mounted to the inner surface of the second side wall 32 via a pivoting joint 46 of conventional design. A support rail 48 is attached to the inside surface of the first side wall 30 opposite to and generally parallel to the pivoting joint 46 of the screen frame 44 in a manner that provides a support surface 50 for the screen frame 44 so that the upper surface 52 of the screen 42 is generally horizontally disposed when the screen 42 is placed over the sand receiving opening 38 as shown in FIG. 3.

The screen 42, as has been described, is pivotally attached via the pivoting joint 46 to the hopper 24 and is selectively disposable in a screening mode and alternatively, in a dumping mode. That is, the screen 42 when placed over the sand receiving opening 38, as shown in FIG. 3, is in its screening mode. Attached to the screen frame 44 are several handle members 54 that may be used to pivot the screen 42 in the direction shown by the arrow 56 so that the screen 42 is pivoted along side of the second side wall 32, the screen 42 being thus placed in its dumping mode wherein the screen 42 can be cleared of any non-passing material.

Figure 4:
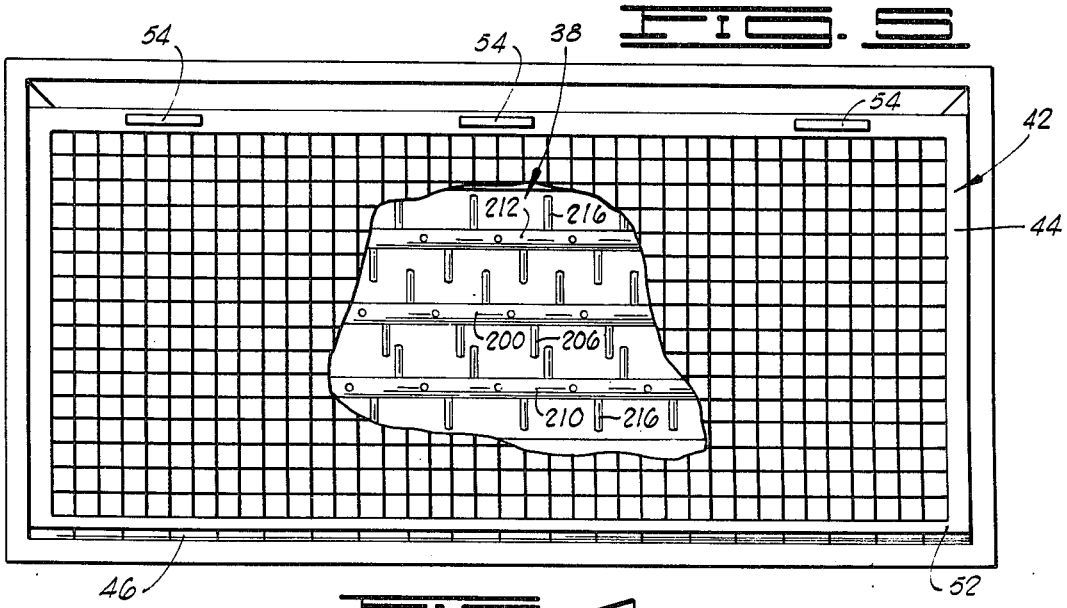
FIG. 4 is a top plan view of the sand bag filling apparatus of FIG. 1 in partial cut-away detail.

As shown in FIG. 4, the screen 42 is comprised of crisscrossing rods that form a sieve having a desired spacing. In practice, it has been determined that a good workable sieve opening of approximately 6 inches by 11 inches serves to catch the bulk of the foreign debris that is found in most sand compositions.

The lower section 26 of the hopper 24 is generally a box-shaped section having a first end wall 58 and a second end wall 60 that are generally parallel and vertically disposed. The lower section 26 also has a first side wall 62 and a second side wall 64 that are also generally parallel and vertically disposed and which are joined with the first and second end walls 58 and 60 by conventional fashion to form the lower portion 26 of the hopper 24. At the lower end of the first side wall 62 is welded an angularly disposed first bottom plate 66 for a purpose that will become clear with the discussion of the adjustable side partitions. In like manner, an angularly disposed second bottom plate 67 is welded to the lower end of the second side wall 64.

The hopper 24 then is comprised of the angularly and upwardly extending first and second side walls 30, 32 and the first and second end walls 34, 36 that adjoin the generally parallel and upwardly extending first and second side walls 62, 64 and the first and second end walls 58, 60. The hopper has a sand receiving opening 38 in the top thereof and a discharge opening 68 at the bottom and running along the length of the hopper 24.

The hopper assembly 12 is supported on a support base 70 via plural support legs 72 that are attached to and extend generally vertically from the support base 70. One support leg is disposed near each of the corners of the lower portion 26 of the hopper 24, and the extension members 74 connect the support legs 72 to the first and second side walls 62 and 64 in conventional manner. The structure of the frame assembly 14 while discussed herein for purposes of the disclosure, is conventional in design and is not considered essential to the practice of the present invention.

As was discussed briefly above, one of the desirable attributes of a sand bagging apparatus 10 is that of mobility. That is, it is often desirable that the sand bagging apparatus 10 be capable of being moved readily to a selected sand bagging site. In the present instance, a powered platform assembly 22 is provided in the form of a powered vehicle 80 having a bed portion 82. The support base 70 is supported by the bed portion 82 as shown in FIG. 1. This arrangement provides for the mounting of the sand bagging apparatus 10 to a conventional truck or the like, and such mounting may be a permanent attachment or it may be desirable to provide non-permanent mounting via conventional bolting techniques.

The conveyor assembly 18 is disposed under the hopper assembly 12 in sand receiving relationship to the discharge opening 68 of the hopper 24. As shown in FIGS. 2 and 3, the conveyor assembly 18 is comprised of a first longitudinal member 86 and a second longitudinal member 88 that are supported by the support legs 72 in generally parallel relationship to each other. The first and second longitudinal members 86, 88 are beams having a C-shaped cross section. A driving drum 90 is bearingly supported by the first and second longitudinal members 86, 88 near the ends 92 thereof, and a driven drum 94 is bearingly supported by the first and second longitudinal members 86, 88 near the other ends 96 thereof. The driving drum 90 and the driven drum 94 are conventional conveyor apparatus, and further detail will not be necessary herein. The driving drum 90 has a supporting arbor 98 that has a gear 100 attached thereto for the purpose of powering the driving drum 90.

An endless conveyor belt 102, fabricated of canvas material or the like, is mounted over the driving drum 90 and the driven drum 94 in the manner shown in FIG. 2, such that the upper portion of the conveyor belt 102 has a travel direction 104 when the driving drum 90 is rotated in a driving direction 106. The driven drum 94 is mounted via bearings that are adjustably positionable along slots 108 in the first and second longitudinal members 86, 88 via conventional bolting techniques, the purpose of which is to vary the distance between the driving drum 90 and the driven drum 94 in order to adjust the tension of the endless conveyor belt 102.

The conveyor assembly 18, structured as described hereinabove, provides an arrangement whereby the upper portion of the conveyor belt 102 is disposed spatially in sand receiving relationship to the hopper discharge opening 68. When the driving drum 90 is powered to rotate in the driving direction 106, by means to be described hereinbelow, the top portion of the conveyor belt 102 will move in the travel direction 104. Consequently, sand that is discharged by the hopper 24 through its discharge opening 68 will be received by the upper portion of the conveyor belt 102 and will travel thereon to the location of the driving drum 90 where the sand will be discharged by the conveyor belt 102 as the conveyor belt 102 turns around the driving drum 90. For convenience of description, the portion of the conveyor belt 102 at the driving drum 90 is referred to as a conveyor discharge end 110, as the purpose of the conveyor assembly 18 is to deliver sand from the hopper 24 to this end upon actuating travel of the conveyor belt 102.

In order to prevent undue spreading of the sand received on the conveyor belt 102 from the hopper discharge opening 68, a mold board assembly 112 is provided. As shown in FIGS. 2 and 3, the mold board assembly 112 comprises a first adjustable side partition 114 that is attached to the first bottom plate 66, and a second adjustable side partition 116 that is attached to the second bottom plate 67 via a plurality of bolts 118 disposed at intervals as required. The first adjustable side partition 114 comprises a holding plate 119 and a molding strip 120, the corresponding bolts 118 passable through appropriately sized apertures in the holding plate 119 and through slots provided in the molding strip 120. This provides an arrangement whereby the molding strip 120 can be adjusted to extend to within very close proximity to the top of the conveyor belt 102. In like manner, the second adjustable side partition 116 comprises a holding plate 122 and a molding strip 124. The molding strips 120 and 124 are made from a relatively soft, but tough and abrasion resistant rubber material or the like and serve as apron skirts to mold the sides of the sand received on the conveyor belt 102. The molding strips 120 and 124 provide molding surfaces that are readily adjustable and replaceable as the abrasiveness of the moving sand wears upon these members. Thus the adjustable molding strips 120 and 124 serve to prevent the sand from spilling over the sides of the belt 102, and the length of the first and second adjustable side partitions 114 and 116 are selected to extend to within close proximity to the conveyor discharge end 110 as shown in FIG. 2.

Figure 5:
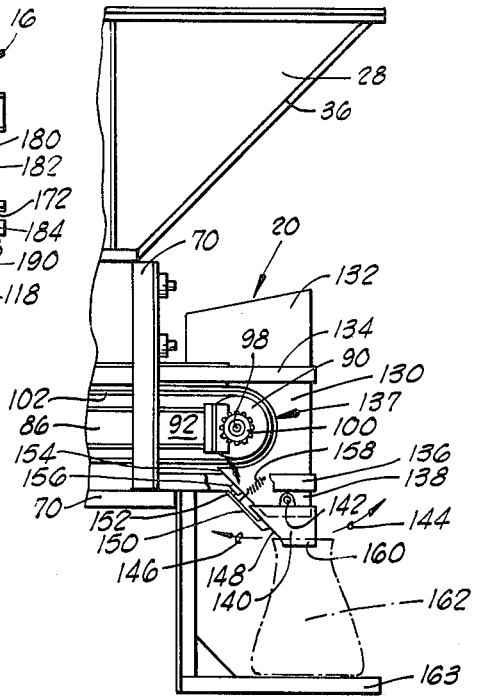
FIG. 5 is a side elevational view of the bag chute and dispensing nozzle of the sand bag filling apparatus of FIG. 1.

The bag chute 20 is generally conventional in construction, except as will be herein described, and is located at the conveyor discharge end 110 as shown in FIG. 1. The bag chute 20 is also shown in FIG. 5 wherein it is depicted in semi-detailed representation. The bag chute 20 is comprised of a hood 130 that is disposed generally near the conveyor discharge end 110 and has a lip portion 132 that extends above the height of the sand to prevent the sand from overflowing the bag chute 20. The bag chute 20 is supported by a pair of support straps 134 and 136 that are attached to the hood 130 and to the support legs 72 that are disposed near the ends 92 of the first and second longitudinal members 86 and 88. The hood 130 has a cutout 137 on each side to provide access to the driving drum 90.

The bag chute 20 has a lower portion 138 having a frusta-conical shape to provide a funnel having a discharge opening for directing the sand that is delivered by the conveyor belt 102 to the conveyor discharge end 110. A dispensing nozzle 140 is supported at the lower portion 138 and is shaped to partially overlap the lower portion 138. The dispensing nozzle 140 is generally funnel shaped and is pivotally supported on the bag chute 20 via a pair of pivot connectors 142 located on opposite sides of the dispensing nozzle 140.

The dimensions of the lower portion 138 of the bag chute 20 and the dispensing nozzle 140 are selectively determined so as to permit limited pivotation of the dispensing nozzle 140 relative to the bag chute 20. That is, the dispensing nozzle 140 which is located in sand receiving relationship to the bag chute 20 is pivotable in a sand delivery direction 144 and in a sand non-delivery direction 146 for a reason that will now be discussed.

Attached to the back surface 148 of the dispensing nozzle 140 is a switch actuating member 150 that is shaped such that an end portion 152 thereof is spatially disposed near the outer surface 154 of the lower portion 138 of the bag chute 20. Attached to the outer surface 154 is a normally closed, spring actuated electrical switch 156 that is engageable by the end portion 152 of the switch actuating member 150. A spring 158 is provided having one of its ends connected to the switch actuating member 150 and its other end connected to the bag chute 20. The spring 158 is selected to have sufficient tension to bias the dispensing nozzle 140 to pivot in the sand non-delivery direction 146. The structure of the switch 156 is conventional and further description will be unnecessary herein. It will be sufficient to state that the switch 156 is manipulated by the pivotation of the dispensing nozzle 140 relative to the bag chute 20. Since the dispensing nozzle 140 is biased by the spring 158 in the sand non-delivery direction 146, the switch 156 will normally be depressed and in an open position.

The dispensing nozzle 140 has a lower portion 160 that has an external dimension sized so that it is receivable in the opening of a sand bag 162 shown in phantom lines in FIG. 5 supported on a platform 163. As will be discussed more fully below, when a sand bag 162 is placed over the lower portion 160 of the dispensing nozzle 140 by an operator of the sand bag filling apparatus 10 and the dispensing nozzle 140 is pulled rotatingly toward the operator in the sand delivery direction 144, the switch actuating member 150 is caused to move away from the switch 156, and the switch 156 thereupon assumes a closed position. The purpose of this arrangement will become clear below with the discussion of the power plant 16 that is provided to drive the conveyor assembly 18.

It should be stated that there are several ways in addition to the spring 158 that the dispensing nozzle 140 can be biased to pivot as described, all of which are contemplated within the scope of the present invention. For example, an alternate construction (not shown) would be to place the pivot connectors 142 in an off-set position relative to the center of gravity of the dispensing nozzle 140 so that the weight of the dispensing nozzle 140 would bias the rotation thereof in the non-delivery direction 146.

Turning now to description of the power plant 16, the discussion will return to FIG. 1 wherein is shown a conventional internal combustion engine 170 that is supported on a stand 172. The stand 172 is supported by the support base 70 via upwardly extending support legs 174. The internal combustion engine 170 is conventional in structure and further description will therefore be unnecessary herein. It will be sufficient to state that the internal combustion engine 170 should be selected so as to have sufficient power to perform the task required by the present invention, it being found that a truck type engine of approximately 300 horse power is usually sufficient. Of course, auxiliary equipment and components that are normally found on such internal combustion engines are required for the operation of internal combustion engine 170, but such items as electrical lines, a fuel source, etc. have been omitted to simplify the drawing in FIG. 1.

The internal combustion engine 170 is connected via an appropriate transmission 176 to drive a power shaft 178 that is mounted via appropriately located bearings attached to the support stand 172 as shown in FIG. 1, and an electrically actuated drive clutch 180 is mounted to the power shaft 178. The drive clutch 180, which is also viewable in FIG. 3, is a conventional clutch having an outer sheave 182 that drives a belt 184. A powered shaft 186 is bearingly supported via conventional bearing blocks attached to one or more support legs 72. The powered shaft 186 extends to a conventional gear reduction box 188 that is supported on the support base 70 near the driving drum 90 of the conveyor assembly 18. The powered shaft 186 has a sheave 190 that is driven by a belt 184 from the sheave 182 when the clutch 180 is actuated electrically; that is, the sheave 190 is driven when electrical energy is supplied to the drive clutch 180 so that the outer sheave 182 is drivingly engaged by the power shaft 178.

The gear reduction box 188 is engaged via a chain and an appropriately sized output drive sprocket with the sprocket 100 that is connected to the driving drum 90 of the conveyor assembly 18. When the powered shaft 186 is caused to turn by the internal combustion engine 170 through the interconnecting means above described, the gear 100 is caused to rotate to driving drum 90 in the driving direction 106, and the upper portion of the conveyor belt 102 is thereupon caused to move in the travel direction 104. Appropriate controls (not shown) may be provided near the bag chute 20 so that the operation of the conveyor belt 102 can be readily controlled by the operator of the sand bag filling apparatus 10.

The structure of the dispensing nozzle 140 along with the electrical switch 156 has been described above. It should now be stated that the switch 156 is electrically connected to the electric drive clutch 180 in an appropriate electric circuit (not shown) having a source of electrical power that is connected to the drive clutch 180 when the switch 156 is closed. That is, when the dispensing nozzle 140 is caused to rotate in the sand delivery direction 144, the switch actuating member 150 is moved away from the switch 156, whereupon the normally closed switch 156 is released and allowed to close. This action causes electrical energy to be supplied to the drive clutch 180 to cause the outer sheave 182 to be powered by the internal combustion engine 170 via the power shaft 178. This in turn drives the driving drum 90 by way of the belt 184, the sheave 190, the powered shaft 186, and the gear reduction box 188. Relating this sequence of actuating events to the conveyor belt 102, it will be understood that the conveyor belt 102 is driven by the driving drum 90 in the travel direction 104 when the switch 156 is closed as a consequence of rotating the dispensing nozzle 140 in the sand delivery direction 144. Conversely, when the dispensing nozzle 140 is released, the spring 158 causes the dispensing nozzle 140 to rotate in the non-delivery direction 146, thereby opening the switch 156 by the switch actuating member 150, and the drive clutch 180 is deenergized, causing the conveyor belt 102 to stop its travel.

At this point in the disclosure, it will be appreciated that the heretofore described embodiment of the present invention will result in the sand that is supplied to the hopper assembly 12 to be passed through the hopper discharge opening 68 to be placed upon the upper portion of the conveyor belt 102, and to be delivered to the bag chute 20 upon actuating the conveyor assembly 18 by the actuating means that has been described above for selectively actuating the power plant 16 to transmit power to the conveyor belt 102. It has been discovered that further refinement to the hopper assembly 12 facilitates and expands the usage of the described equipment. Returning now to FIG. 2, a description will be provided of an agitating assembly provided as part of the hopper assembly 12 for the purposes of imparting lifting energy to the sand contained in the hopper 24, and for conditioning the sand.

Disposed within the lower section 26 of the hopper 24 are three longitudinal members that are generally parallel to each other and which are journaled for rotation about their longitudinal axes. A first longitudinal member 200 is supported in the hopper 24 by way of block bearing 202 supported on the first end wall 58 and a block bearing 204 supported on the second end wall 60, the first longitudinal member 200 passing through appropriately sealed apertures in these end walls. A plurality of radially extending arm members 206 are connected to the first longitudinal member 200 at intervals therealong. The arm members 206 are rod members that extend generally normal to the first longitudinal member 200 and are of a length determined to clear the first and second side walls 62 and 64 of the lower section 26 of the hopper 24 as the first longitudinal member 200 is rotated. Several rows of the radially extending arm members 206 are provided and the arm members 206 are placed in a spatial pattern such that the first longitudinal member 200 is balanced during rotation thereof.

In like manner to that which has been described for the first longitudinal member 200 above, a second longitudinal member 210 and a third longitudinal member 212 are also disposed in the lower section 26 and are supported by block bearings 214 that are supported on the first and second end walls 58 and 60 of the lower section 26 of the hopper 24. The second longitudinal member 210 and the third longitudinal member 212 are positioned in side by side spatial relationship to each other above the hopper discharge opening 68 in the manner indicated in FIG. 3. A plurality of radially extending arm members 216 are connected to the second and third longitudinal members 210 and 212 in the manner described above for the radially extending arm members 206. The radially extending arm members 216 are spaced in rows about the respective first and second longitudinal members 200 and 210 in a predetermined spatial pattern wherein the first and second longitudinal members are balanced upon rotation thereof. The position of the first and second longitudinal members 200 and 210 and the length of each of the radially extending arms 216 are determined so that the radially extending arm members 216 will clear the first and second side walls 62 and 64 of the lower section 26 of the hopper 24. Also, the spatial distribution of the radially extending arm members 206 and 216 is established so that these arm members clear each other in a meshing and cooperating manner so that the sand that is placed into the hopper 24 is engaged by the arm members 206 as the first, second and third longitudinal members 200, 210 and 212 are rotated in the manner to be described.

The first longitudinal member 200 has an end 220 that extends through the block bearing 202 and has a drive sprocket 222 mounted thereon. Also, a gear 224 is mounted adjacent to the drive sprocket 222 on the end 220 of the first longitudinal member 200. In like manner, the second longitudinal member 210 has an end 226 that extends through the block bearing 214 at the first end wall 58 and a gear 228 is mounted thereon. Further, the third longitudinal member has an end 230 that extends through the block bearing 214 at the first end wall 58 and a gear 232 is attached thereto.

As shown in FIG. 1, a gear 240 is supported on the power shaft 178 in back of the drive clutch 180. A drive chain 242 is provided to connect the drive sprocket 222 to the gear 240, thereby providing a power link between the power shaft 178 and the drive sprocket 222, resulting in the turning of the first longitudinal member 200 by the power plant 16 via the power shaft 178. Further, the sprocket 224 located on the first longitudinal member 200, the sprocket 228 connected to the second longitudinal member 210, and the sprocket 232 connected to the third longitudinal member 212 are located in coplanar relationship to each other and a chain 244 is provided for interconnecting and driving the three sprockets, 224, 228, and 232, in unison when the first longitudinal member 200 is rotated by the drive sprocket 222. This arrangement of interconnecting gears and chain interconnections provides for the rotation of the first, second and third longitudinal members 200, 210, 212 with rotation of the power shaft 178 by the internal combustion engine 170.

As the first, second and third longitudinal members 200, 210 and 212 are caused to rotate, the sand that is placed in the hopper 24 is agitated by the rotation of the plurality of radially extending arm members 206 and 216. The result is that the sand placed in the hopper 24 is provided energy by the rotating arm members, causing the sand to generally lift in the hopper 24 in a manner that results in a lightening of the load of the sand on the conveyor 102. This significantly decreases the power that is required to move the conveyor belt 102 in the travel direction 104. This beneficial action is believed to result from decreasing the force necessary to shear the sand by the conveyor moving the lower portion of the sand toward the conveyor discharge end 110. The rotation speed of the first, second and third longitudinal members 200, 210 and 212 may be varied as required for a particular application, and it has been observed that there appears to be a speed at which further rotational speed increases result only in the adverse effect of causing sand to be thrown out of the hopper 24. In the embodiment shown in the accompanying figures, good results have been achieved at rotation speeds of approximately 250 r.p.m., but this will vary with the size of the equipment together with other factors such as the length and spacing of the arm members extending from the longitudinal members.

Another benefit derived by the agitating assembly represented by the first, second and third longitudinal members 200, 210 and 212 is the conditioning of the sand that results in the vigorous agitation as the radially extending arm members 206 and 216 energize the sand. The result of this is that higher moisture contents in the sand can be tolerated before a problem is incurred with sand packing in the hopper 24.

The above description of the preferred embodiment of the present invention clearly demonstrates the usefulness and many benefits derived from the improvements of the present invention. It will be apparent from the foregoing, to those skilled in the art, that the apparatus decribed in detail above provides an apparatus that will achieve the objects of the present invention, as well as those inherent thereto. Changes may be made in the construction and the arrangement of the parts or the elements of the embodiment described herein without departing from the spirit and scope of the invention as defined in the following claims.

What is claimed is:

1. An apparatus for receiving bulk sand and for bagging the sand, comprising:

a frame assembly;

a hopper assembly supported by the frame assembly and comprising a hopper having a discharge opening, the hopper assembly being further characterized as comprising agitating means for imparting lifting energy to the sand contained in the hopper, the agitating means being characterized as comprising:

a first longitudinal member journally supported in the hopper;

a plurality of radially extending arm members connected to the first longitudinal member in a spatial pattern wherein the sand is caused to be fluffed by the arm member as the longitudinal member is rotated;

a second longitudinal member journally supported in the hopper in generally parallel relationship to the first longitudinal member;

a plurality of radially extending arm members connected to the second longitudinal member in a spatial pattern wherein the sand is caused to be fluffed by the arm members as the second longitudinal member is rotated, the arm members of the second longitudinal member meshingly cooperating with the arm members of the first longitudinal member;

a third longitudinal member journally supported in the hopper in generally parallel relationship to the first longitudinal member and the second longitudinal member;

a plurality of radially extending arm members connected to the third longitudinal member in a spatial pattern wherein the sand is caused to be fluffed by the arm members as the third longitudinal member is rotated, the arm members of the third longitudinal member meshingly cooperating with the arm members of the first longitudinal member and the second longitudinal member; and rotating means for rotating the first longitudinal member, the second longitudinal member, and the third longitudinal member;

a conveyor assembly supported by the frame assembly comprising a conveyor belt disposed spatially in sand receiving relationship to the discharge opening;

power means connected to the conveyor assembly for selectively powering the conveyor belt in an actuated mode;

a bag chute supported by the frame assembly and disposed spatially in sand receiving relationship to the conveyor belt; and actuating means for selectively actuating the power means to transmit driving power to the conveyor belt.

2. The apparatus of claim 1 wherein the bag chute is characterized as having a sand discharge opening and the actuating means is further characterized as comprising:

a dispensing nozzle pivotally supported on the bag chute in sand receiving relationship to the discharge opening thereof, the dispensing nozzle being pivotal in a sand delivery direction and in a sand non-delivery direction;

switch means having an on position and an off position, the switch means actuating the power means to power the conveyor belt when positioned in the on position and the conveyor belt being stopped when the switch means is in off position, the switch means being positioned in the on position when the dispensing nozzle is pivoted in the sand delivery direction and the switch means being positioned in the off position when the dispensing nozzle is pivoted in the sand non-delivery direction;

bias means for rotating the dispensing nozzle in the sand non-delivery direction.

3. The apparatus of claim 2 wherein the hopper has a sand receiving opening and the apparatus is further characterized as comprising:

a screen pivotally attached to the hopper and selectively disposable in a screening mode and in a dumping mode, the screen being positioned over the sand receiving opening in the screening mode and alternately, the screen being positioned removed from the sand receiving opening in the dumping mode wherein the screen is cleared of non-passing material.

4. The apparatus of claim 3 further comprising:

powered platform means supporting the frame assembly for selectively moving the apparatus to a selected sand bagging site.

5. An apparatus for filling bags with sand, comprising:

a frame;

a hopper having a sand receiving opening and a sand discharging opening;

agitating means for imparting lifting energy to the sand in the hopper whereby the sand is placed into a fluffed condition;

a conveyor belt supported by the frame and disposed spatially in sand receiving relationship to the hopper discharge opening, the conveyor belt movable to deliver sand received from the hopper to a conveyor discharge end;

power means connected to the conveyor belt to selectively power the conveyor belt whereupon sand on the conveyor belt is delivered to the conveyor discharge end;

a bag chute supported by the frame and disposed to receive sand delivered by the conveyor belt to the conveyor discharge end thereof, the bag chute having a discharge opening;

a dispensing nozzle pivotally supported on the bag chute in sand receiving relationship to the discharge opening thereof, the dispensing nozzle being pivotal in a delivery direction and in a non-delivery direction;

switch means actuated by the pivoting of the dispensing nozzle for actuating the power means to power the conveyor belt whereby the conveyor belt is powered when the dispensing nozzle is pivoted in the delivery direction and the conveyor belt is stopped when the dispensing nozzle is pivoted in the non-delivery direction; and bias means for rotating the dispensing nozzle in the non-delivery direction.

6. The apparatus of claim 5 wherein the agitating means is characterized as comprising:

a first longitudinal member journally supported in the hopper;

a plurality of radially extending arm members connected to the first longitudinal member in a spatial pattern wherein the sand is caused to be fluffed by the arm members as the longitudinal member is rotated;

rotating means for rotating the first longitudinal member.

7. The apparatus of claim 6 wherein the agitating means is further characterized as comprising:

a second longitudinal member journally supported in the hopper in generally parallel relationship to the first longitudinal member;

a plurality of radially extending arm members connected to the second longitudinal member in a spatial pattern wherein the sand is caused to be fluffed by the arm members as the second longitudinal member is rotated, the arm members of the second longitudinal member meshingly cooperating with the arm members of the first longitudinal member;

a third longitudinal member journally supported in the hopper in generally parallel relationship to the first longitudinal member and the second longitudinal member;

a plurality of radially extending arm members connected to the third longitudinal member in a spatial pattern wherein the sand is caused to be fluffed by the arm members as the third longitudinal member is rotated, the arm members of the third longitudinal member meshingly cooperating with the arm members of the first longitudinal member and the second longitudinal member; and, the rotating means is further characterized as rotating the second and third longitudinal member.

8. The apparatus of claim 7 further comprising:

powered platform means supporting the frame for moving the apparatus to a selected sand bagging site.

9. The apparatus of claim 5 further characterized as comprising:

a screen supported by the hopper over the sand receiving opening thereof.

10. The apparatus of claim 5 further comprising:

powered platform means supporting the frame for moving the apparatus to a selected sand bagging site.

* * * * *